US008297359B2

(12) United States Patent
McKay et al.

(10) Patent No.: US 8,297,359 B2
(45) Date of Patent: Oct. 30, 2012

(54) SUBSEA WELL INTERVENTION SYSTEMS AND METHODS

(75) Inventors: Thomas Kean McKay, Spring, TX (US); Michael J. Bednarz, Katy, TX (US)

(73) Assignee: BP Corporation North America Inc., Houston, TX (US)

( * ) Notice: Subject to any disclaimer, the term of this patent is extended or adjusted under 35 U.S.C. 154(b) by 441 days.

(21) Appl. No.: 12/511,471

(22) Filed: Jul. 29, 2009

(65) Prior Publication Data

US 2010/0025044 A1 Feb. 4, 2010

Related U.S. Application Data

(60) Provisional application No. 61/085,043, filed on Jul. 31, 2008.

(51) Int. Cl.
*E21B 43/36* (2006.01)
*E21B 43/01* (2006.01)

(52) U.S. Cl. ..... 166/359; 166/339

(58) Field of Classification Search ..... 166/351, 166/367, 368, 359, 345, 350
See application file for complete search history.

(56) References Cited

U.S. PATENT DOCUMENTS 5,447,392 A 9/1995 Marshall
6,053,252 A 4/2000 Edwards
6,102,125 A 8/2000 Calder
2004/0074635 A1 4/2004 Collie et al.
2005/0189115 A1 9/2005 Rytlewski et al.
2006/0151175 A1 7/2006 Sundararajan et al.

FOREIGN PATENT DOCUMENTS

WO WO 01/25593 A1 4/2001

OTHER PUBLICATIONS

"Well Access Systems," FMC Technologies, 2008.
Hognestad, et al. "Open Sea Workover and Completion Riser Systems," Drilling & Well Technology, Business Briefing: Exploration & Production: The Oil & Gas Review, 2004, pp. 94-96.
PCT International Search Report and Written Opinion dated Feb. 25, 2010 for International Application No. PCT/US2009/052090.
PCT International Preliminary Report on Patentability issued in related application No. PCT/US2009/052090, mailed Feb. 1, 2011, 6 pages.

*Primary Examiner* — Thomas Beach
*Assistant Examiner* — James Sayre
(74) *Attorney, Agent, or Firm* — Jayne C. Piana

(57) ABSTRACT

Systems and methods for well intervention include a lower riser package (LRP), and an emergency disconnect package (EDP). The LRP includes a tree connector, a connector and seal stab adapter (CSSA), and a LRP body; the tree connector has a profile for mating to the CSSA. The CSSA has at least one seal stab assembly for fluidly connecting with a subsea tree. The body of the LRP includes one or more sealing elements that are capable of sealing upon command, an integral annulus with an annulus isolation valve, an upper hub profile compatible with the EDP, and a lower flange profile that mates with the CSSA. The EDP includes a quick disconnect connector, at least one annulus isolation valve, and one or more sealing elements that are capable of sealing upon command. In some embodiments, an internal tie-back tool connects to the EDP via an EDP internal tie-back profile.

26 Claims, 8 Drawing Sheets

SUBSEA WELL INTERVENTION SYSTEMS AND METHODS

CROSS-REFERENCE TO RELATED APPLICATIONS

This application claims domestic priority benefit under 35 U.S.C. §120 from applicant's provisional patent application Ser. No. 61/085,043, filed Jul. 31, 2008, which is fully incorporated herein by reference.

BACKGROUND INFORMATION

1. Technical Field

The present disclosure relates in general to well control and intervention methods and systems. More particularly, the present disclosure relates to well control and intervention methods and systems used for well completion, flow testing, well stimulation, well workover, diagnostic well work, bullheading operations, plugging wells and/or abandoning wells, where subsea trees or wellheads are installed. In an embodiment, these systems and methods are deployed using a slickline, e-line, coiled tubing or jointed tubulars, for example.

2. Background Art

The Current practice for well control and intervention for wells completed with horizontal subsea trees is to use a Subsea Test Tree (SSTT) system. For vertical subsea trees a Completion Work-Over Riser (CWOR) system is typically used. SSTT and CWOR systems are complicated mechanically, and not readily available. The rental cost per well intervention for a SSTT is approximately $US 5 million to 10 million whereas the purchase cost for a CWOR, which is not typically rented, is $US 55 million to $75 million.

U.S. Pat. No. 6,053,252 discloses an intervention apparatus that is said to essentially replicate the pressure control functions of a blowout preventer (BOP) stack. The intervention package consists of five main parts: a lower first wellhead connector which connects to the exterior of the tree mandrel; a cylindrical housing formed of lower housing and upper housing and which define an internal diameter which is substantially the same as the tree mandrel interior diameter; an upper second tree connector; a sub-sea test tree with two ball valves located within the upper part of the housing and also within the upper connector, and a proprietary tree cap intervention tool disposed in the lower part of the housing and the top part of the first connector. The housing parts are coupled together by a circular connector clamp such as a Cameron clamp and the top connector is coupled to a stress joint which forms the bottom end of the tubing riser; the stress joint also receives coiled tubing.

As explained U.S. Pat. No. 6,053,252, after testing the pressure integrity of the system, the test tree valves are opened, a wireline tool is run to pull the plug from the tree cap and a second run is made to pull a plug from the tubing hanger. Wireline can be run if needed, for example to insert a valve to facilitate flow or to provide a logging function. Communication with the surface through the annulus is a complicated procedure achieved by running a tubing annulus bridge on a wireline. This allows an annulus port inside the horizontal tree to be connected to an annulus void within the intervention package while being separated from the main bore, thus allowing control of the annulus for various functions such as pumping or stimulation operations via the crossover facility in the tree cap running tool, the annulus port and the coiled tubing riser to surface. The tubing annulus bridge is generally cylindrical and has first and second concentric elements which are of different lengths. The interior longer element and the outer and shorter length element define an annular cavity which opens at the top end of the bridge to register with an aperture disposed in the bottom of the tubing hanger running/tree cap intervention tool. This aperture is closeable by a sleeve which is hydraulically actuatable to move longitudinally within an annular cavity so as to cover or uncover the aperture.

It would be advantageous if a well intervention system and method could be developed that meets or exceeds the prior art systems and methods, and is also less complicated in operation and less costly to manufacture and rent than existing prior art systems and methods. The systems and methods of the present disclosure are directed to these needs.

SUMMARY

In accordance with the present inventive disclosure; well intervention systems and methods have been developed which reduce or overcome many of the limitations and faults of previously known systems and methods. In certain embodiments of in the invention, the systems and methods may also be riserless.

A first aspect of the disclosure is a marine riser well intervention tie-back system comprising:

a) a lower riser package (LRP) comprising a tree connector, a connector and seal stab adapter (CSSA), and a lower riser package body (LRP body), the tree connector comprising an upper flange having a gasket profile for mating to a lower end of the CSSA, the CSSA comprising at least one seal stab assembly on its lower end for fluidly connecting to a subsea tree, the LRP body comprising one or more LRP sealing elements that seal upon command and/or that are capable of sealing upon command (i.e., have the ability to seal upon command), for example, upon a control signal initiated by a human operator. In certain embodiments, the LRP sealing elements may include, but are not limited to, a shearing ram (comprised of a shearing/cutting element fitted with hardened tool blades designed to cut), a sealing ram (comprised of hydraulically and/or pneumatically operated sealing rams), a shearing ram and sealing ram (separate rams that independently shear or seal) or a shearing-sealing ram (a ram that both shears and seals), and further optionally a gate valve, a ball valve, or another type of valve, or another shearing ram and sealing ram or a shearing-sealing ram, or a combination thereof, and an integral annulus with at least one annulus isolation valve, the LRP body comprising an upper hub profile compatible with an emergency disconnect package (EDP) connector and a lower flange profile that fluidly mates or connects with the CSSA;

b) an emergency disconnect package (EDP) removably connected to the LRP, the EDP comprising a body (EDP body) having a quick disconnect connector on its lower end, one or more EDP sealing elements (in certain embodiments this may be an inverted blind shearing ram that cuts and retains fluid from above), and at least one annulus isolation valve, the EDP body having an internal tie-back profile;

c) an internal tie-back tool (ITBT) removably connected to the EDP body via the internal tie-back profile; and d) a collapse-resistant flexible hose fluidly connecting the LRP to subsea tree.

In an embodiment, the disconnect feature of the EDP can be initiated by an operator, where the conditions are appropriate, for example, when there are dangerous drilling, completion, diagnostic well work, work-over operations, or dangerous well or operating conditions, or a malfunction in the dynamic positioning system of a rig (if present), or possible impending weather conditions that warrant leaving the area, such as approaching storms or hurricanes, for example.

Further in an embodiment, it is the same ram that shears and seals. In another embodiment the ram that shears is different from the ram that seals. Additionally in an embodiment, the rams are sets i.e., opposing pairs. Also in an embodiment, the shearing ram and sealing ram and/or the shearing-sealing ram are operated hydraulically but, for example, can also have a mechanical override that is operated by an ROV, for example.

In certain embodiments, the system comprises an existing marine riser, an existing riser mandrel connecting the marine riser to an existing flexible joint, the flexible joint connected to the body of the EDP, and a pressure containing tubular inserted through these components and matingly connected to the internal tie-back profile of the EDP using an internal tie-back tool. The combination of the ITBT and pressure containing tubulars provides a pressure containment system from subsea to surface. The ITBT locks and seals into the EDP body through weight-set, rotation, or pressure assist means or through ROV intervention. In certain embodiments, the system further comprises a hose connecting an existing marine riser adapter to an annulus isolation valve on the EDP. In certain embodiments one hose connects a kill or choke line of the marine riser to an integral annulus isolation valve (52A in FIG. 3). This hose, in conjunction with the flange gasket profile and integral annulus (86 in the FIG. 3), provides production bore containment and an annulus path for circulation purposes via the body of the EDP. The collapse-resistant hose connecting the LRP body to the subsea tree provides a circulation path via the tree using either the choke or kill line. In another embodiment, the collapse-resistant hose may be eliminated if the tree CSSA incorporates another seal stab assembly that can interface with another suitable profile within the subsea tree. Yet other systems of the present disclosure may comprise one or more rams (for example, inverted blind shear rams) in the EDP.

Systems within the present disclosure may take advantage of existing components of an existing BOP stack, such as flexible joints, riser adapter mandrel and flexible hoses including the BOP's hydraulic pumping unit (HPU). Also, the subsea tree's existing Installation WorkOver Control System (IWOCS) umbilical and HPU may be used in conjunction with a subsea control system comprising an umbilical termination assembly (UTA), a ROV panel, accumulators and solenoid valves, acoustic backup subsystems, a subsea emergency disconnect assembly (SEDA), hydraulic/electric flying leads, and the like, or one or more of these components supplied with the system.

Another aspect of the invention is a method of well intervention, the method comprising:

a) deploying an EDP/LRP stack subsea on a subsea tree connected via ROV to a well, the EDP/LRP stack being on the end of a marine riser;
b) deploying pressure containing tubulars with an ITBT attached thereto through the marine riser;
c) connecting the pressure containing tubulars to a surface flow tree;
d) landing the ITBT in an EDP body, and locking the ITBT to the EDP body; and
e) performing an intervention operation on the well using the EDP/LRP, ITBT, and pressure containing tubulars.

Well intervention operations may proceed via slickline, e-line, coiled tubing, or jointed tubulars (provided the surface arrangement includes a hydraulic workover unit). Methods of this inventive disclosure may be used for interventions such as, but not limited to, well completion, well clean-up, flow testing, well workover, well stimulation, diagnostic well work, bullheading operations, to kill or shut-in a well, and for plugging wells and/or abandoning wells.

Certain system embodiments may comprise the combination of an EDP/LRP stack with a subsea lubricator section and adapter to enable methods of riserless well intervention using a slickline or e-line from a Multi-Support Rig (MSR).

Certain other system embodiments may comprise the combination of an EDP/LRP stack with an open water completion workover riser system comprising a tapered stress joint, riser joints, a surface tension joint, surface termination joints and surface tree. These systems can be deployed from a Mobile Offshore Drilling Unit (MODU) or a WorkOver Vessel (WOV) to permit well intervention methods using a slickline, e-line, coiled tubing, or jointed tubulars. These methods may be used for interventions such as, but not limited to, well clean-up, flow testing, well stimulation, diagnostic well work, bullheading operations, killing or shutting-in a well, for plugging wells and/or abandoning wells.

The systems and methods described herein may provide other benefits, and the methods for well intervention are not limited to the methods noted; other methods may be employed.

These and other features of the systems and methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which.

Figure 1A:
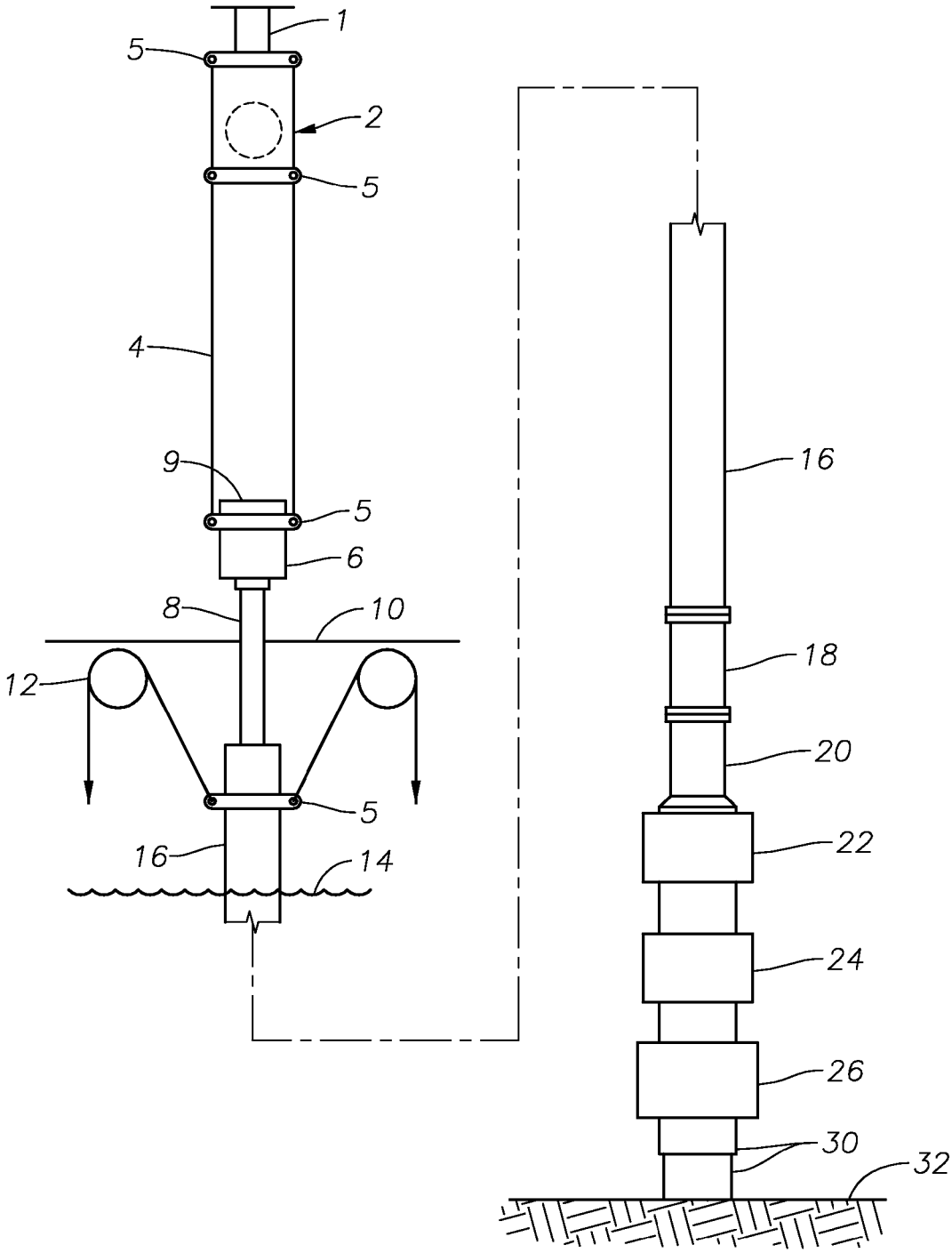
FIG. 1A is a schematic side elevation view of one system embodiment within the present disclosure, with FIG. 1B illustrating some details of some prior art surface system components useful in practicing methods in conjunction with systems within this disclosure.

It is to be noted, however, that the appended drawings are not to scale and illustrate only typical embodiments of this disclosure, and are therefore not to be considered limiting of its scope, for the invention may admit to other equally effective embodiments. Identical reference numerals are used throughout the several views for like or similar elements.

DETAILED DESCRIPTION

Definitions

The following terms as used herein may be defined as follows:

Tubulars—as used herein, the term tubulars includes tubing or system of tubes, tubulars, pipes, pipelines, flowlines, and the like used for holding or transporting any liquids and/or gases, and any incidental particulate matter or solids, from one location to another.

Bullheading operations—as used herein, the term bullheading or bullheading operations is defined to mean and include: the act of forcibly pumping fluids into a formation, and such formation fluids have entered the wellbore during a well control event. Bullheading may be performed if normal circulation cannot occur, such as after a borehole collapse. Further, bullheading is risky; the primary risk is that a drilling crew has no control over where the fluid goes, and can cause a broach that has the effect of fluidizing and destabilizing the subsea floor.

Emergency shutdown (ESD) controller—as used and defined herein, the ESD controller is comprised of a controller that facilitates or is capable of initiating an emergency shutdown.

Emergency quick disconnect (EQD) controller—as used and defined, herein, the EQD controller is comprised of a controller that facilitates or is capable of initiating an emergency quick disconnect of the involved components.

Emergency disconnect package (EDP)—as used herein, the term Emergency disconnect package (EDP) provides a way of disconnecting the pressure containing riser from the LRP in an emergency, or when the rig is obliged to move off location due to inclement weather, leaving the LRP and tree closed in on the seabed, for example.

"Emergency disconnect package (EDP)/lower riser package (LRP) stack" or "EDP/LRP stack"—as used herein, the phrase emergency disconnect package (EDP)/lower riser package (LRP) stack or EDP/LRP stack, means and includes the combination of the emergency disconnect package (EDP) with the lower riser package (LRP) stack.

Internal tie-back tool (ITBT)—as used and defined herein, the internal tie-back tool is a tool comprising a distal end region that matingly connects the pressure containing tubular to the internal tie-back profile of the EDP body.

Flange—as used and defined herein, the term flange refers to an external or internal rib or rim.

Internal tie-back profile—as used and defined herein, the term internal tie-back profile refers to the shape of an internal region defined by the EDP body that matingly connects to the corresponding distal end region of the internal tie-back tool.

Inverted blind sealing ram (or inverted sealing blind ram) refers to a blind sealing ram that is installed so that it is able to close over or seal a connection made to a well (and not close over the well, per se), such as during well intervention operations.

Inverted blind shear ram (also sometimes referred to in the art as blind shearing rams, shearing blind rams or SBRs)—as used and defined herein, the term inverted blind "shear ram" or "shearing ram" refers to a shearing or cutting element fitted with hardened tool steel blades designed to cut/shear a pipe (and/or something else) when the valve or BOP is closed; a shear ram is normally used as a last resort to regain pressure control of a well that is flowing; a blind shear ram has no space for pipe and is instead blanked off in order to be able to close over a well that does not contain a drillpipe; inverted blind shear rams can be used in order to retain fluids or pressure situated above the inverted blind shear ram.

Integral annulus—as used and defined herein, the term integral when referring to an annulus, refers to an annulus that is cast or machined into an EDP or LRP body, as the case may be, and the term annulus refers to the space between two substantially concentric objects (or between two substantially concentric regions of an EDP body or LRP body), such as between the wellbore and casing, or between casing and tubing, where fluid can flow.

Integral annulus valve—as used herein, the phrase "integral annulus valve" refers to a valve having an integral annulus that eliminates a costly wireline operation to use and remove an annulus plug.

Mandrel—as used and defined herein, the term mandrel refers to a tool component that grips or clamps other tool components.

Multi-Support Rig (MSR)—as used herein, the term Multi-Support Rig (MSR) includes drill ships, vessels, platforms, spars, semi-submersibles, floating systems, or other structures that float or which are known to one skilled in the art to be useful for drilling, completion, diagnostic well work, work-overs, bull-heading, maintenance, plugging, abandonment, or shut-ins of wells, for example.

Pressure containing tubulars—as used and defined herein, the term pressure containing tubulars refers to the ability of a tubular to convey a pressurized fluid to or from the EDP/LRP stack as desired by an operator. In one example, the internal pressure of the pressure containing tubulars may be as high as 15 Ksi (103 MPa), for example, and may also have higher or lower pressure ratings.

Profile—as used and defined herein, the term profile refers to the outermost shape, view, or edge of an object.

Quick disconnect connector—as used herein, the term quick disconnect connector is comprised of a connector that facilitates or is capable of initiating a quick disconnect of the involved or currently connected components or parts.

Shearing-sealing ram—as used herein, the term "shearing-sealing ram" or "shear-sealing ram" refers to a ram that has the ability to shear or cut pipe (or something else) and then seal in one closure, or in one step. One or more shearing-sealing rams may be used.

In the following description, numerous details are set forth to provide an understanding of the disclosed methods and apparatus. However, it will be understood by those skilled in the art that the methods and apparatus may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

As noted above, marine riser well intervention tie-back systems and methods have been developed which reduce or overcome many of the limitations or faults of previously known systems and methods.

Figure 1B:
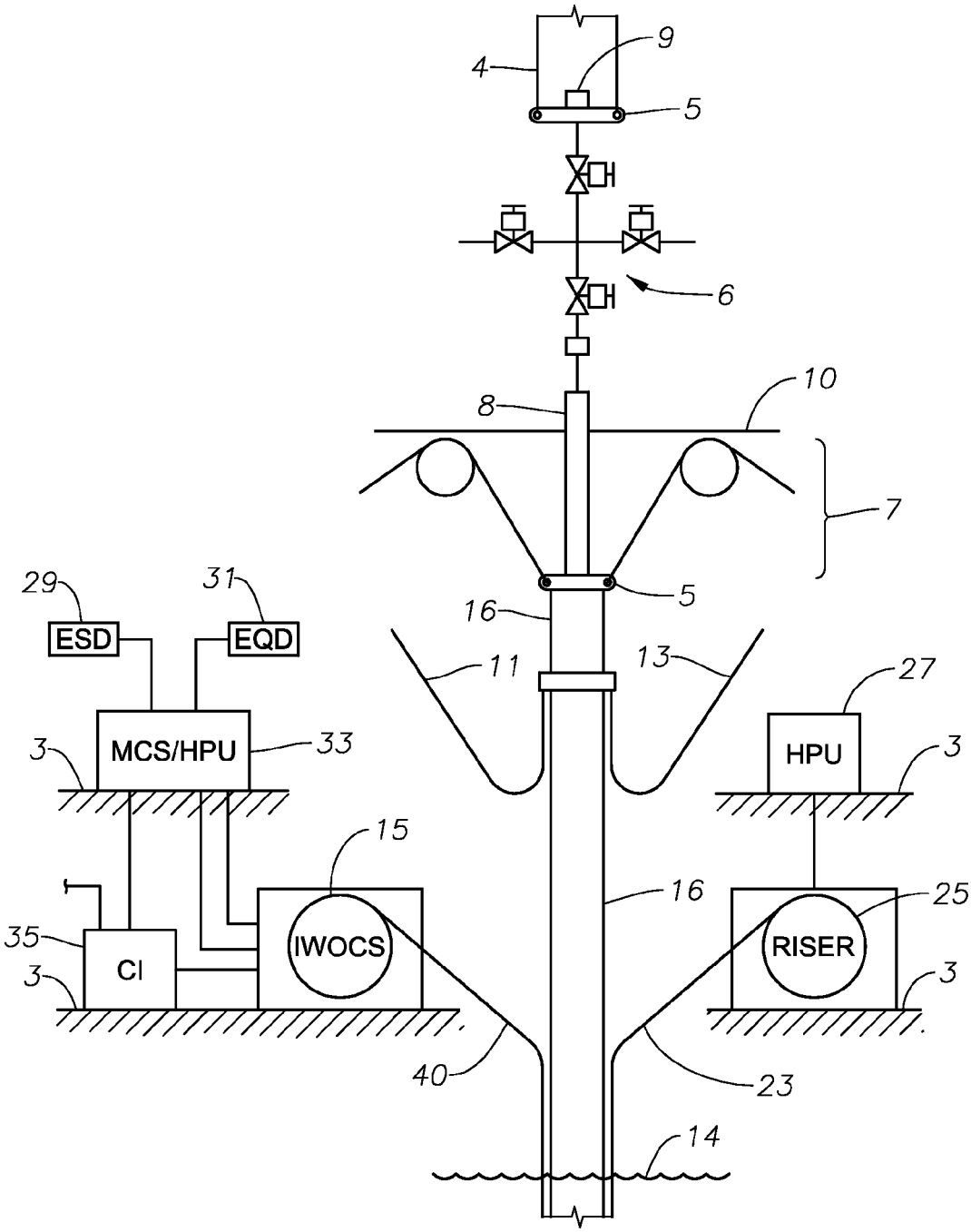
Fig. 1B (Prior Art)

The primary features of the systems and methods of the present disclosure will now be described with reference to FIGS. 1-6, after which some of the operational details will be explained. The same reference numerals are used throughout to denote the same items in the figures. The systems and methods disclosed herein can be used in one or more operations related to well completion, flow testing, well stimulation, well workover, diagnostic well work, bullheading operations, plugging wells and/or abandoning wells where subsea trees or wellheads are installed. In accordance with the present disclosure, as illustrated in FIG. 1A, a typical subsea intervention set-up includes a compensated hook 1, a bail winch 2, bails 4, elevators 5, a surface flow tree 6, and a coiled tubing or wireline BOP 9, all above a drill floor 10 of a Mobile Offshore Drilling Unit (MODU—not shown). These components are known to skilled artisans and require no further explanation. Other existing components include marine riser tensioners 12, a marine riser 16 which protrudes through the sea surface 14 down through the sea to a riser mandrel 18, flexjoint 20 (also referred to herein as a flexible joint), a subsea tree 26, and wellhead 30, which are also known to skilled artisans. Components contributed by the systems and methods of the present disclosure include pressure containing tubulars 8, an emergency disconnect package (EDP) 22, and a lower riser package (LRP) 24. The lower riser package provides a hydraulic interface between the tree assembly and the EDP. The internal tie-back string 8, EDP 22, LRP 24 and other components and their operation are more fully explained in reference to FIGS. 2-6. FIG. 1B illustrates more details, such as marine riser tensioners 7, choke line 11, kill line 13, IWOCS reel 15 and IWOCS umbilical 40, ESD (emergency shutdown) controller 29 and EQD (emergency quick disconnect) controller 31, IWOCS MCS (master control station)/HPU 33, a chemical injection (CI) unit 35, a hydraulic line 23 and reel 25. The reels 15 and 25, HPU 27, MCS/HPU 33, and Cl 35 may be on a deck 3 of a MODU.

Figure 2B:
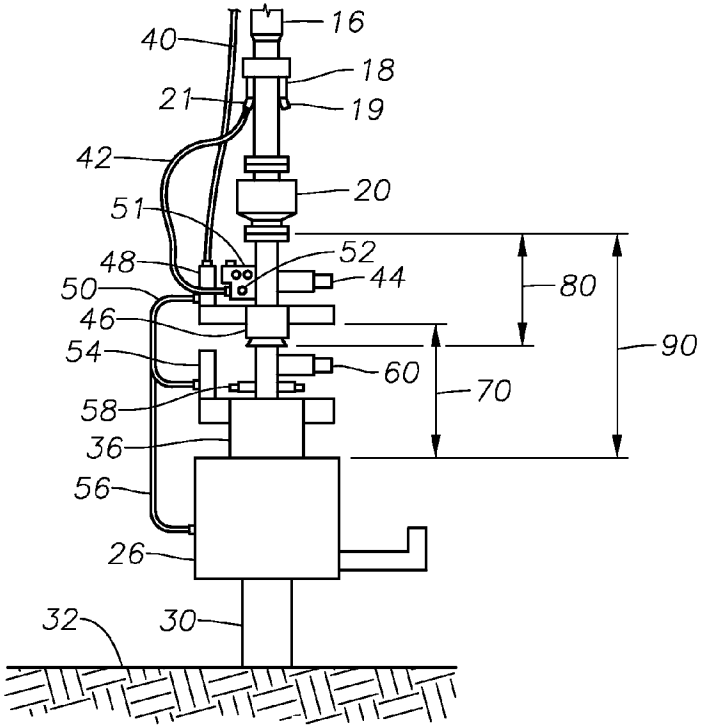
FIG. 2B illustrates schematically a side elevation view of a system embodiment in accordance with the present disclosure.
Figure 2A:
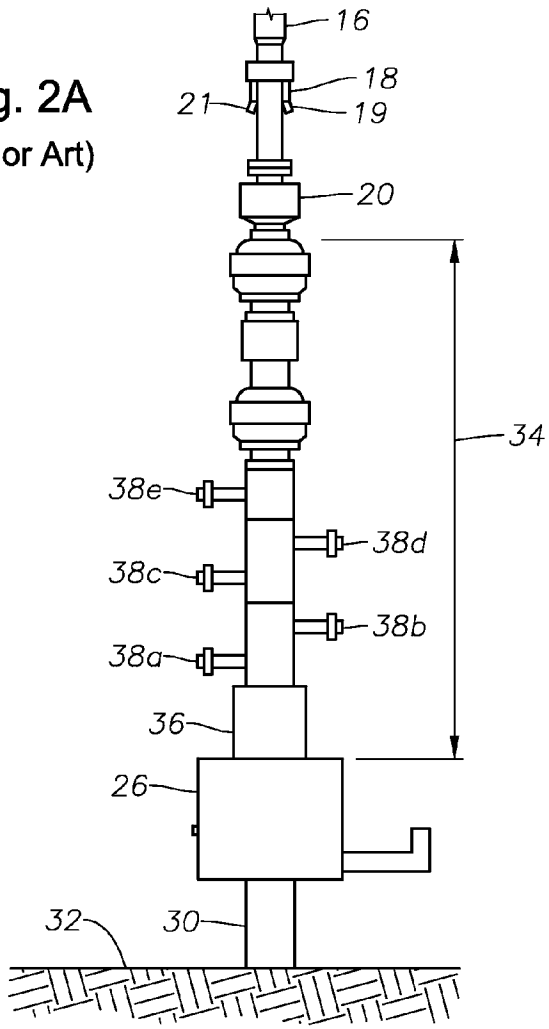
Fig. 2A (Prior Art)
FIG. 2A illustrates schematically a side elevation view, partially in cross-section, of a prior art BOP system.

Prior to delving into details of systems and methods of the present disclosure, it is helpful to compare one system of the disclosure to a previously known, conventional BOP stack. A conventional BOP stack is illustrated in side elevation, partially in cross-section, in FIG. 2A, and one system embodiment 200 within the disclosure is depicted in FIG. 2B. The conventional BOP stack is connected to a marine riser 16, a riser adapter or mandrel 18 having kill and choke connections 19 and 21, respectively, and a flexjoint 20. The BOP stack 34 typically comprises a series of rams 38*a-e*, and a wellhead connector 36. The wellhead 30 and mud line 32 are also illustrated. The BOP stack at 34 is typically 43 feet (13 meters) in height, although it can be more or less depending on the BOP design, and of course, such BOP stacks which are of other heights are contemplated to also be useful in this invention.

In contrast, embodiment 200 illustrated schematically in FIG. 2B includes two main components, the LRP 70 and the EDP 80, which together in an embodiment have a height 90 of about 18.5 feet (5.6 meters). Of course, the use of such components which are of other heights are contemplated to also be useful in this invention. Embodiment 200 includes an umbilical 40, sometimes referred to as an "Installation WorkOver Controls System" umbilical, or "IWOCS" umbilical herein, which connects to an umbilical termination assembly 48, which in turn connects with hydraulic fluid lines 50 and 56 (a portion of line 56 is hidden in this view by line 50) and electrical flying lead 51. Line 50 in turn connects to a hydraulic control system 54. A flexible hose 42, such as made from a high strength, flexible material such as that known under the trade designation COFLON™ or other high strength, flexible material known to a skilled artisan, connects the kill or choke line connection 21 to an annulus control valve 52 in EDP 80. COFLON™ is a trademark of Coflexip Corporation, Paris, France. In this embodiment, the one or more EDP sealing elements are comprised of an inverted blind shearing ram and an inverted blind sealing ram or shearing-sealing ram 44, and quick release connector 46 complete EDP 80 in this embodiment. Further in this embodiment, the LRP 70 includes one or more LRP sealing elements, comprising a lower shearing ram and sealing ram or a shearing-sealing ram set 58 and a lower isolation valve 60, which may be a gate valve or other valve. In other embodiments, lower isolation valve 60 could be replaced by a second shearing ram and sealing ram or a second shearing-sealing ram set. The shearing element may cut wireline, e-line, coiled tubing, and jointed tubulars, and the like. Further other sealing elements known to one skilled in the art that provide metal to metal sealing faces, with or without secondary elastomeric backup can be used as the LRP sealing elements and/or EDP sealing elements in the embodiments disclosed herein.

Figure 3:
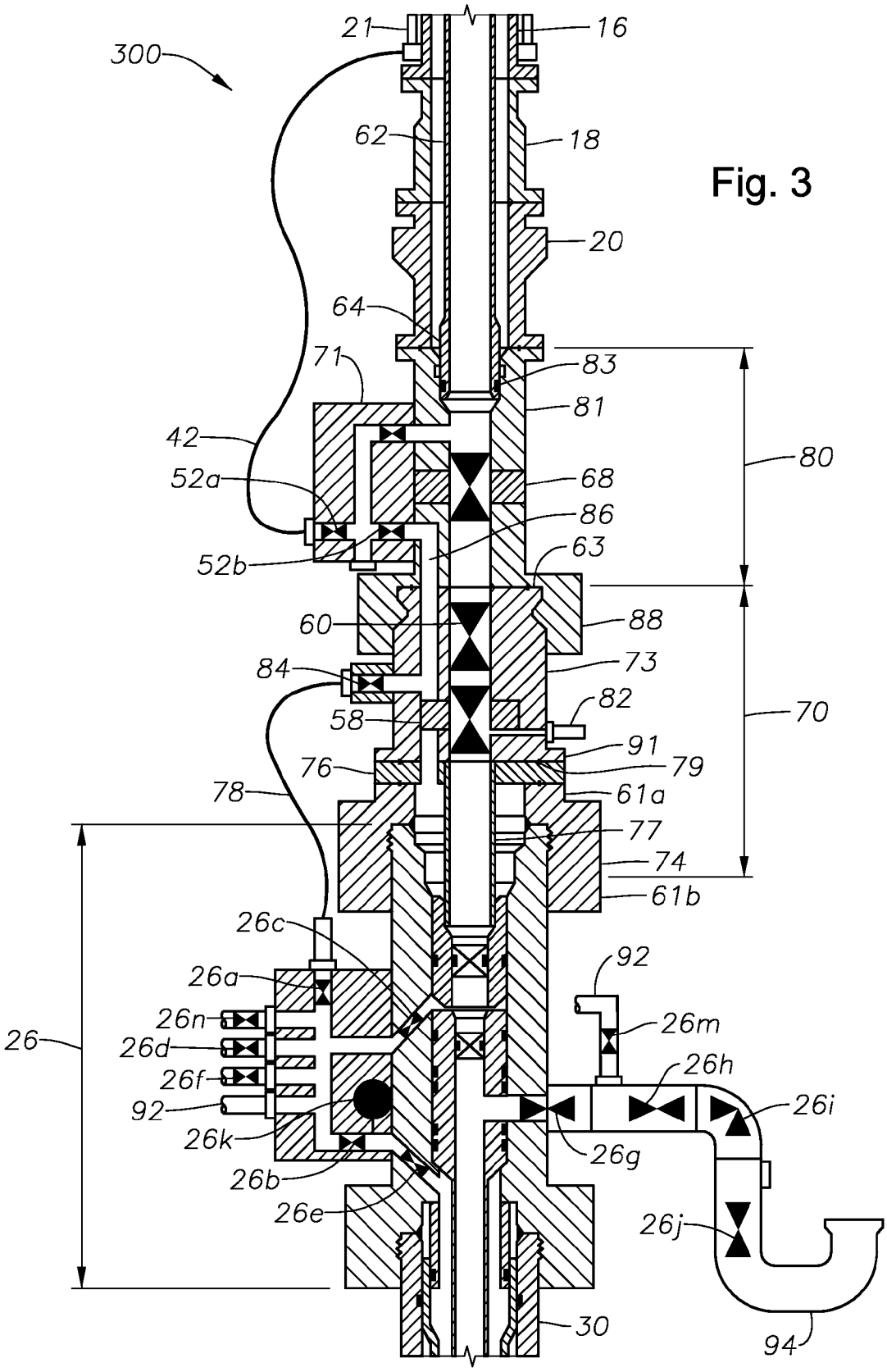
FIG. 3 illustrates schematically a more detailed side elevation view, partially in cross-section, of one system embodiment in accordance with the present disclosure.

FIG. 3 illustrates schematically, partially in cross-section, a more detailed side elevation view of one system in accordance with the present disclosure. Embodiment 300 of FIG. 3 illustrates in detail EDP 80 and LRP 70, as well, as internal riser 62 connected to an internal tie-back tool (ITBT) 64. In an embodiment, the EDP 80 includes a body 81 having a quick disconnect connector 88 on its lower end, an upper inverted blind shearing ram 68, the EDP body 81 having an internal tie-back profile 83 for mating with a distal end region of ITBT 64. In an embodiment, the body of the EDP and/or the LRP is a body that is capable of pressure containment and can also accommodate, contain, hold, or house pressure control or sealing elements, such as valves, rams, or shearing elements (in certain embodiments the shearing and sealing functions may be performed by the same element). In a further embodiment, the EDP body and/or the LRP body may be comprised of a spool body. Embodiment 300 includes first, second, and third annulus control gate valves 52*a*, 52*b*, and 52*c*, respectively, in a valve block 71. Flexible hose 42 connects the kill or choke line 21 with first annulus control gate valve 52*a*.

The LRP 70 includes a body 73, a connector and seal stab adapter (CSSA) 76, and a tree connector 74. Tree connector 74 comprises an upper flange 61*a* having a gasket profile that mates with CSSA 76 and a lower end 61*b* for connecting to a subsea tree 26. CSSA 76 comprises at least one seal stab assembly 77 on its lower end for fluidly connecting with subsea tree 26, and an upper flange and gasket profile 79 for mating with the LRP body 73. The body 73 includes a lower sealing ram 58 and a lower isolation valve 60, a lower flange 91 having a profile for matingly connecting with upper flange 79 of CSSA 76, and an upper flange 63 having same profile. The LRP body 73 mates with the EDP body 81 through a quick disconnect connector 88. Embodiment 300 includes a collapse-resistant hose jumper 78 that fluidly connects tree 26 with another gate valve 84 for flow circulation through integral annulus 86, as well as a pressure and temperature measuring unit 82. In an embodiment, the pressure and temperature measuring unit 82 is mounted to the body of the LRP. In an embodiment, the pressure and temperature measuring unit is flange-mounted to the body.

The details of subsea tree 26 are not considered part of the systems and methods disclosed herein; subsea trees are known to skilled artisans. For complete disclosure, however, the components and their reference numbers listed in Table 1 are illustrated in FIG. 3. In addition, a crossover conduit 92 and production conduit 94 are depicted.

Figure 4:
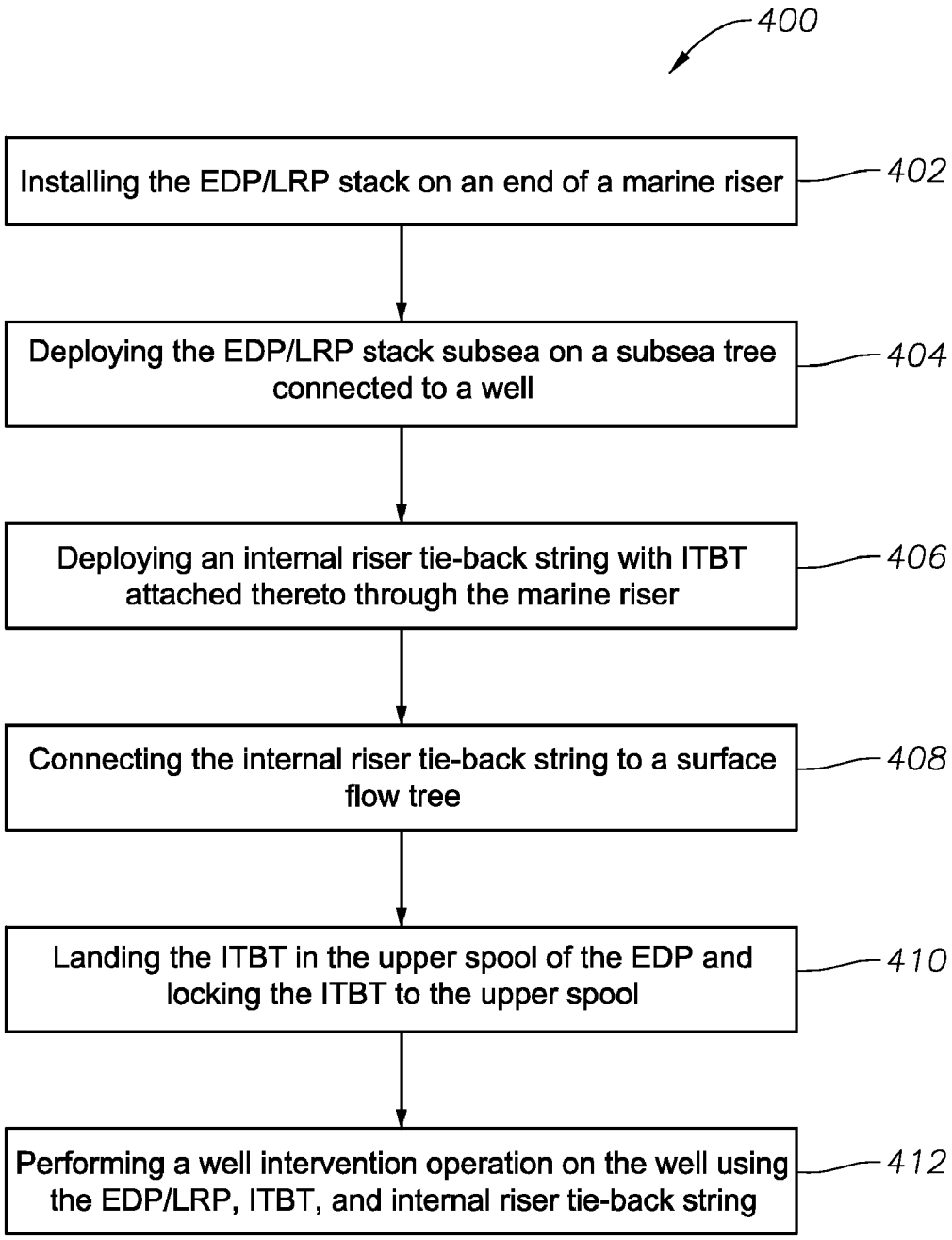
FIG. 4 illustrates a logic diagram of a method of using the embodiment of FIG. 3.

FIG. 4 illustrates a logic diagram of a method embodiment 400 within the invention. Embodiment 400 depicts in box 402 installing the EDP/LRP stack on an end of a marine riser, the LRP including a connector and seal stab adapter (CSSA). The adapter is important because it allows the systems and methods disclosed herein to be used on numerous subsea trees, providing additional well intervention flexibility not seen in previously known EDP/LRP stacks. Next in box 404, the method comprises deploying the EDP/LRP stack subsea on a subsea tree connected to a well. In the next step, box 406 pressure containing tubulars with ITBT attached thereto is deployed through the marine riser. Next in box 408, the pressure containing tubulars is connected to a surface flow tree, followed by landing the ITBT into the internal body of the EDP and locking the ITBT to the EDP body (box 410). Lastly in embodiment 400, a well intervention operation is performed on the well using the EDP/LRP, ITBT, and pressure containing tubulars (box 412).

TABLE 1

Subsea Tree Components

| Subsea Tree Component Name | Reference Numeral |
|---|---|
| AAV—Annulus Access Valve | 26a |
| AIV—Annulus Isolation Valve | 26b |
| ACV—Annulus Circulating Valve | 26c |
| AWV—Annulus Wing Valve | 26d |
| AMV—Annulus Master Valve | 26e |
| AVV—Annulus Vent Valve | 26f |
| PMV—Production Master Valve | 26g |
| PWV—Production Wing Valve | 26h |
| PCV—Production Choke Valve | 26i |
| PIV—Production Isolation Valve | 26j |
| PTT—Pressure Temperature Transducer | 26k |
| XOV—Crossover Valve | 26m |
| CT4—Chemical injection valve | 26n |

Figure 5B:
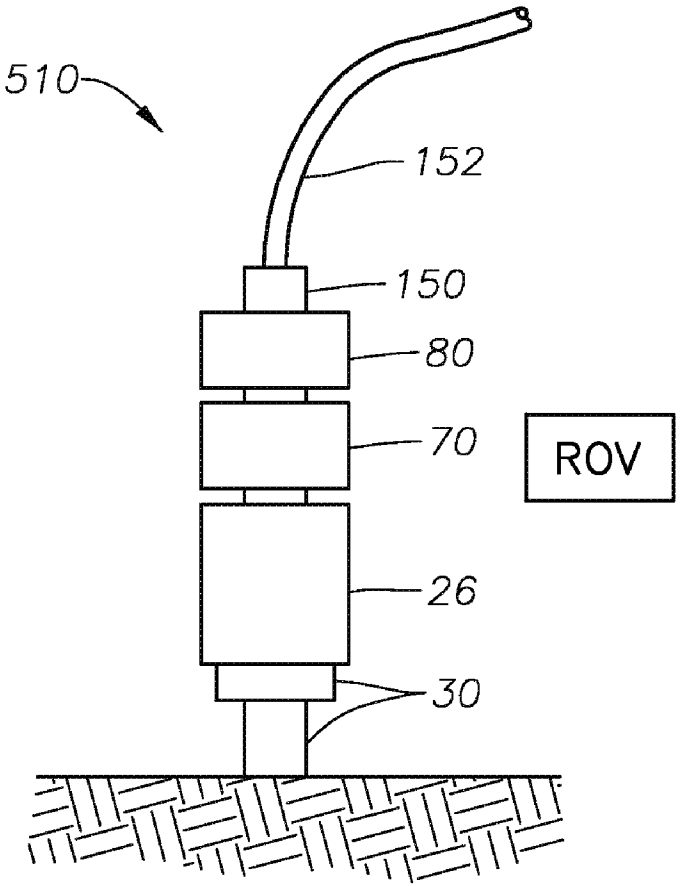
FIGS. 5A, 5B and 6 are schematic illustrations of three other system embodiments within the invention.
Figure 5A:
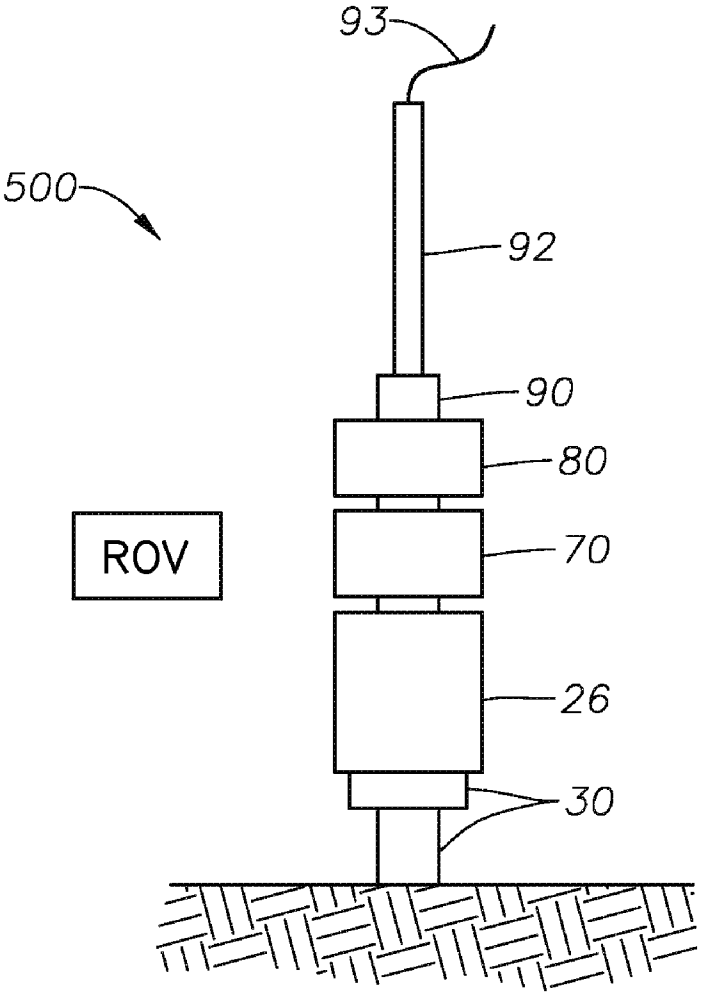

As mentioned previously, certain system embodiments may comprise the combination of an EDP/LRP stack with a subsea lubricator section and adapter to enable methods of riserless well intervention using a slickline or e-line from a Multi-Support Rig (MSR). A schematic representation of such an embodiment is illustrated in FIG. 5A as embodiment 500. Wellhead 30 connected to a subsea tree 26 are not considered parts of the inventive systems and methods. Subsea tree 26 connects with an EDP 70, which in turn is connected to an LRP 80, as described in more detail in FIG. 3. In some embodiments, the quick disconnect connector may be locked out by an ROV or other device. Embodiment 500 differs from embodiment 300 of FIG. 3 by having a lubricator 92 fluidly connected to LRP 80 by an adapter 90, allowing a wireline or slickline 93 to access the well. Lubricators and suitable adapters are known in the art, but their combination with an EDP/LRP in accordance with this disclosure is not heretofore known. One subsea lubricator and systems and methods for circulating fluids in a subsea lubricator are disclosed in published Patent Cooperation Treaty patent application number PCT/NO00/00318, published Apr. 12, 2001, incorporated herein by reference for it disclosure of subsea lubricator devices. Other lubricator devices may be used. FIG. 5B illustrates an additional embodiment 510, comprising the same components as embodiment 500 of FIG. 5A, but replacing adapter 90, lubricator 92, and wireline or slickline 93, with an adapter 150 and coiled tubing 152. Embodiment 510 allows for a variety of well interventions to be carried out on the subsea well, including, but not limited to, well clean-up, flow testing, well stimulation, well workover, diagnostic well work, bullheading operations, killing or shutting-in a well, and for plugging wells and/or abandoning wells.

Figure 6:
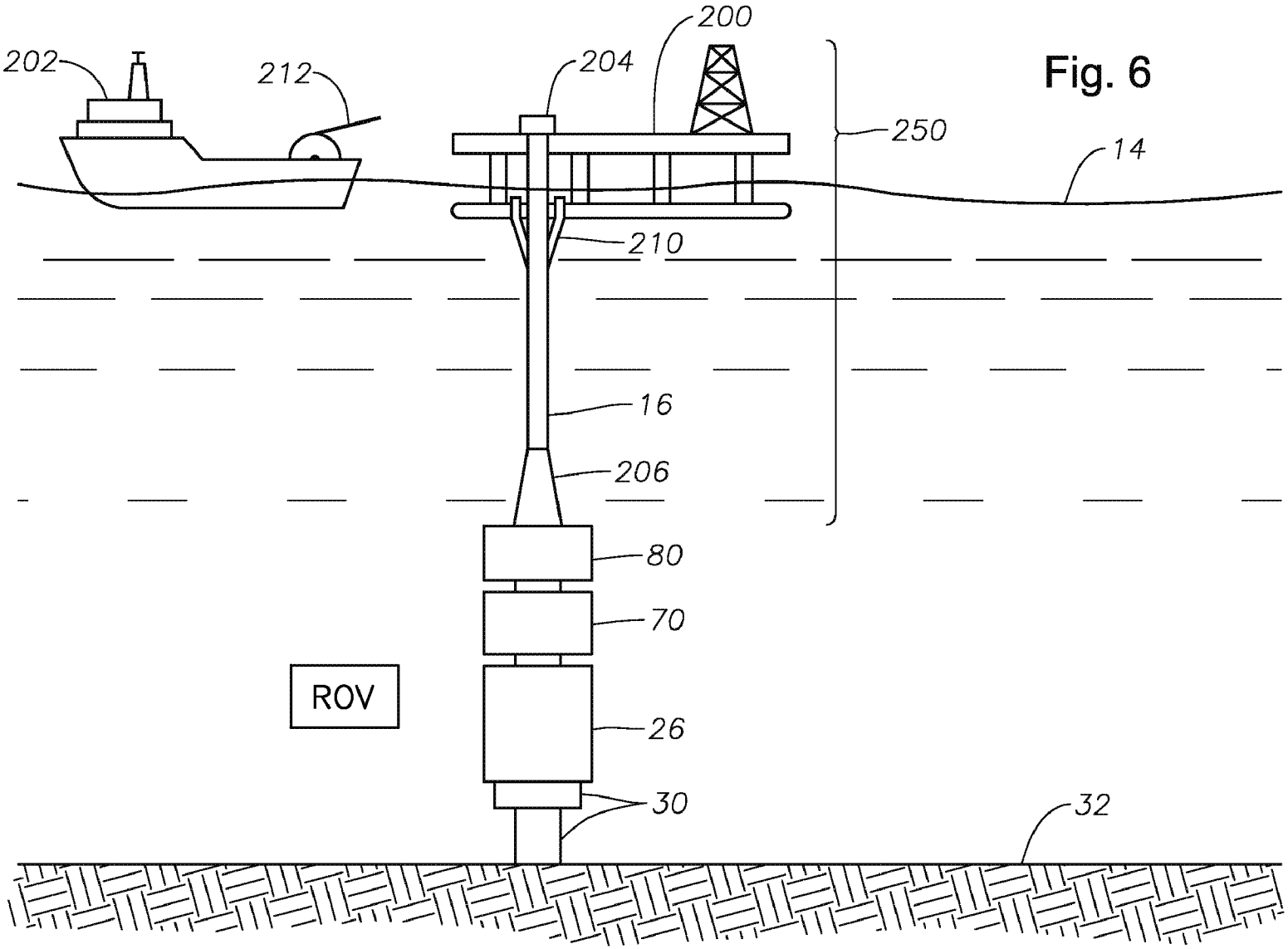

As illustrated in FIG. 6, certain other system embodiments may comprise the combination of an EDP/LRP stack (80, 70) such as described herein with an open water (or "open sea") completion workover riser (CWOR) system 250, such as available from FMC Technologies, Houston, Tex., and other subsea equipment suppliers. These workover riser systems may comprise a variety of joints and tension systems, surface termination joints and a surface tree 204. Suitable joints and tension systems include, but are not limited to a tapered stress joint 206, riser joints 208, and surface tension joints 210. These joints and tension systems are engineered on a project specific basis for overall length, wall thickness and taper length. For example, they may comprise fatigue-resistant compact flanges and threaded riser connections, and may be constructed from steel open die forgings and designed for high fatigue applications, high fracture toughness and large bending moments. Suitable tension joints 210 include, but are not limited to simple fixed lock-off tensioner systems, or more exotic hydro-pneumatic tensioner systems, either "pull-up" (as depicted schematically at 210) or "push-up" type. The fixed lock-off types may comprise upper and lower passive load rings interfacing with electronic load cells allowing for access and maintenance, and may include adjustment nuts allowing for riser tension adjustment. These systems may be deployed from a Mobile Offshore Drilling Unit (MODU) 200 (as depicted in FIG. 6) or from a WorkOver Vessel (WOV) 202 to permit well intervention methods using a slickline, e-line, coiled tubing (212) or jointed tubulars. These methods may be used for interventions such as, but not limited to, well completion, well clean-up, flow testing, well stimulation, diagnostic well work, bullheading operations, killing or shutting-in a well, and for plugging wells and/or abandoning wells.

In accordance with the present disclosure, a primary interest lies in using one or more of the methods and systems described above to perform a well intervention operation on a subsea well. The skilled operator or designer will determine which system and method described herein is best suited for a particular well and formation to achieve the highest efficiency, safest, and environmentally sound well intervention without undue experimentation.

Systems and methods of the present disclosure may be used to complete, workover and/or plug and abandon wells when a subsea tree is used. Systems described herein replace the need to use Subsea Test Trees (SSTT) or open water Completion Workover Riser (CWOR) systems, although as mentioned they may be used in conjunction with systems and methods described herein. The main driver behind the described systems is to deliver a well intervention system that is simpler, safer, reliable and more cost effective than the alternative SSTT and CWOR well intervention systems currently in use. The systems of the present disclosure primarily use existing and proven equipment repackage to achieve the required functionality to ensure well control during any well completion, intervention or plug and abandonment operation. Certain systems and methods of the present disclosure involve deploying a subsea well control package onto a subsea tree using a MODU's existing marine riser and tensioning system. Since systems of the disclosure may be deployed from a floating vessel with dynamic positioning capability, the subsea package advantageously includes an emergency disconnect feature.

In embodiments wherein the LRP/EDP has been landed and tested, a high pressure internal tie-back string is run within a riser and locked into the EDP, this arrangement provides a high pressure conduit from the well bore to the surface and is protected by the marine riser. This configuration is expected to provide a wider environmental operability window than other well intervention systems and provides the ability to circulate the contents of the riser and subsea tree using the marine riser's choke or kill line being used. The existing hydraulic conduit supply and riser boost lines of the marine riser may also be used. The hydraulic conduit supply may be used to feed hydraulic pressure to the subsea control circuits and the riser boost may be used to circulate the annulus (i.e., to force a fluid into the main bore which then circulates back up into the annulus to e.g. remove hydrocarbons, debris, cuttings, and the like) between the internal tie-back string and marine riser. The internal tie-back string is supported at the surface by the rig's block (i.e., the active heave draw works or crown motion compensator) connected via a surface tree, bails and elevators.

Figure 7:
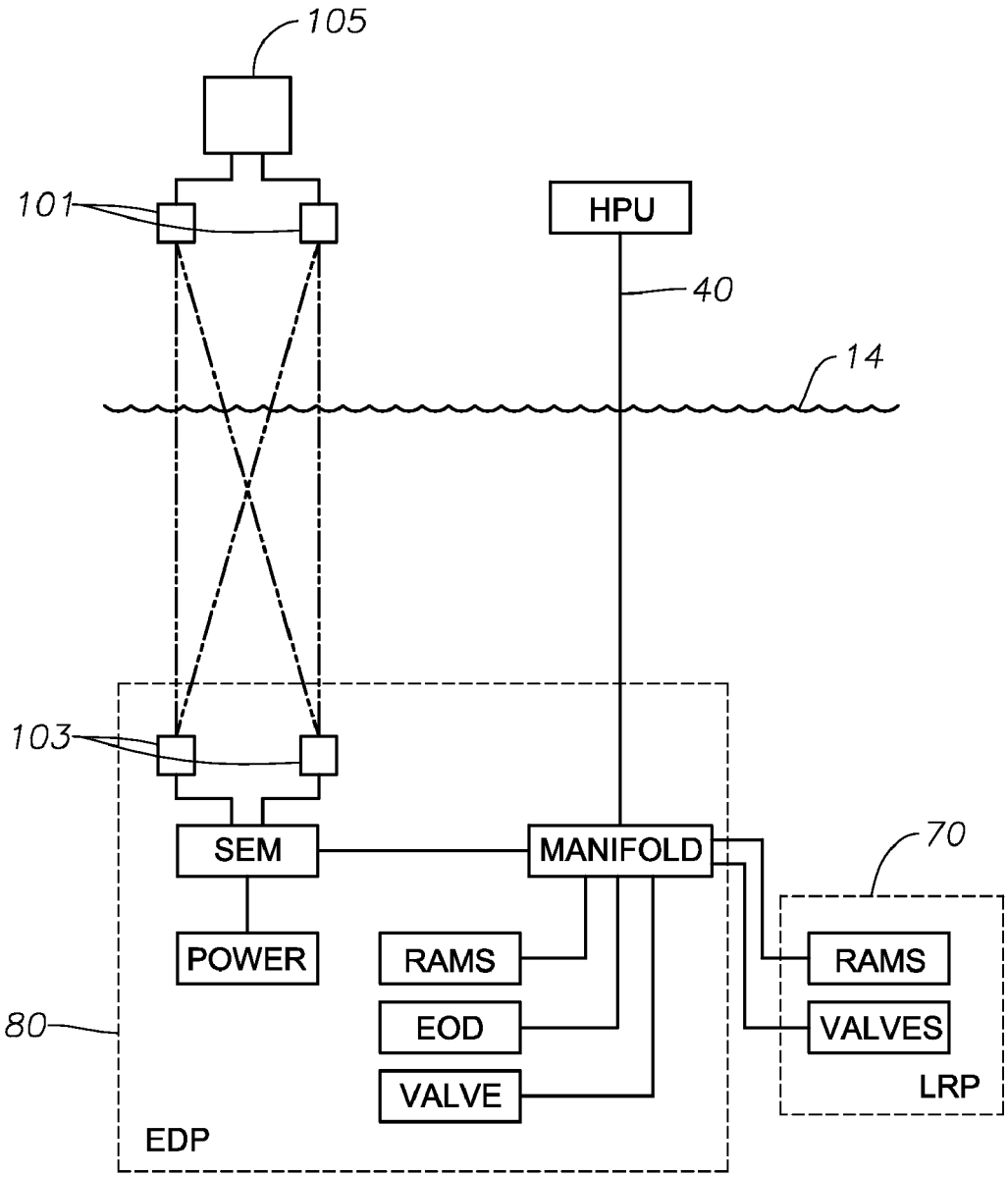
Fig. 7 (Prior Art)
FIG. 7 illustrates schematically a prior art acoustic deadman package useful in the systems and methods of this disclosure.

Suitable control systems for use in implementing systems and methods described herein may be simple hydraulic/electric/mechanical configurations that may use a combination of the drilling riser's hydraulic conduit line and spare lines within an existing IWOCS umbilical, or, if not available, then an appropriate umbilical and reel may be supplied as a part of the inventive systems. The hydraulically actuated shearing ram and sealing ram or a shearing-sealing ram and isolation valves may be functioned by piloting subsea solenoid valves via dedicated spare lines in the IWOCS umbilical. The solenoid valves when piloted will direct pressurized fluid from local accumulators to the corresponding valve, ram or connector actuator. The local subsea accumulators may be supplied hydraulic pressure via the drilling riser's hydraulic conduit line. Emergency shut-in and disconnect may be achieved by direct electric or acoustic signal. In an embodiment, the emergency shut-in and disconnect are initiated by a human operator. The acoustic signal may be part of an acoustic deadman package such as illustrated schematically in FIG. 7, illustrating acoustic transceivers 101 and 103 and an acoustic control unit 105.

One subsea system embodiment within the disclosure may comprise the following components:

an ROV-operated tree connector. In an embodiment, the ROV-operated tree connector is an 18¾ inch (47.6 cm) diameter, 15 Ksi (103 MPa) pressure-rated ROV-operated tree connector that interfaces with either, for example, a Super Heavy Duty H4 (SHD-H4) (27-inch or 30-inch OD) (68 cm or 76 cm OD) connection profile, e.g. made by Vetco Gray, or DWFC, e.g. made by FMC profiles. Other parts and components of other sizes, diameters, dimensions and of other pressure-ratings that are known to one skilled in the art, or are commercially available, or are compatible with other commercially available components can also be used;

a connector and sea stab adapter comprising at least one seal stab assembly that fluidly connects with the tree connector and production bore of the subsea tree (a specific connector and seal stab adapter will be required for each unique combination of tree connector type and subsea tree production bore profile, and skilled artisans will readily be able to engineer such adapters having the benefit of this disclosure);

a LRP body comprising a blind shearing ram and sealing ram or a shearing-sealing ram and isolation valve (or another set of blind shearing rams and sealing rams or another set of blind shearing-sealing rams) in the production bore with annulus access. In an embodiment, the LRP body is comprised of a 7¹⁄₁₆ inch. (17.9 cm) diameter, 15 Ksi (103 MPa) pressure-rated blind shearing-sealing rams or a blind shearing ram and sealing ram. The upper profile has a hub profile with concentric gasket profiles that provide production bore containment and an annulus path that connect to either the choke or kill lines, respectively, via the EDP body. In an embodiment, the hub profile has 7-inch and 11-inch (17.8 cm and 27.9 cm) gasket profiles. Other parts and components of other sizes, diameters, dimensions and of other pressure-ratings that are known to one skilled in the art, or are commercially available, or are compatible with other commercially available components can also be used. A high collapse-resistant hose with ROV hot stab or Multi Quick Connect (MQC) plate connects the LRP body to the subsea tree and provides another desirable circulation path via the tree using either the choke or kill line. Both the LRP body, connector and seal stab adapter and connector are considered to be the Lower Riser Package (LRP);

an EDP body with Quick Disconnect connector (QDC) and an inverted blind shearing and sealing rams and internal tieback profile in the production bore; isolation valves with a wing block which provide annulus flow paths. In an embodiment, the Quick Disconnect connector (QDC) is 7¹⁄₁₆ inch (17.9 cm) in diameter, with a 15 Ksi (103 MPa) pressure-rating, and the isolation valves are 2¹⁄₁₆ inch (5.2 cm) in diameter, with a 15 Ksi (103 MPa) pressure-rating. In an embodiment, the lower profile has concentric gasket profiles compatible with the upper profile flange. In an embodiment, the lower profile has concentric 7-inch and 11-inch (17.8 cm and 27.9 cm) gasket profiles. In an embodiment, the upper profile has an 18¾-inch (47.6 cm) diameter, 15 Ksi (103 MPa) pressure-rated flange. Other parts and components of other sizes, diameters, dimensions and of other pressure-ratings that are known to one skilled in the art, or are commercially available, or are compatible with other commercially available components can also be used. The choke or kill line that terminates on the riser adapter (existing component from BOP stack) are connected to annulus access valves via flexible COFLON™ hoses. The integral body, annulus wing block and the QDC are considered the Emergency Disconnect Package (EDP) in this embodiment;

an internal tie-back tool (ITBT) and riser string, which locks and seals into the EDP body through ROV intervention;

a flexjoint, riser adapter mandrel and flexible hoses (may be existing components of the subsea BOP stack);

a subsea control system comprising an umbilical termination assembly (UTA), ROV panel, accumulators and solenoid valves, acoustic backup, subsea emergency disconnect assembly (SEDA), and hydraulic/electrical flying leads;

a Surface Flow Tree (SFT) with integral hydraulically actuated gate valves on the vertical run with non-integral hydraulically actuated gates valves on the side outlets. In an embodiment, the integral hydraulically actuated gate valves are 7¹⁄₁₆ inch (17.9 cm) in diameter, with a 15 Ksi (103 MPa) pressure-rating on the vertical run, with non-integral hydraulically actuated gates valves 3¹⁄₁₆-inch (7.8 cm) in diameter, with a pressure-rating of 15 Ksi (103 MPa). The valve outlets may be equipped with elbows and hubs for connection to flexible hoses. In an embodiment, Cameron #6 Hubs may be used for connection to flexible COFLON™ hoses. A pressure transmitter may be incorporated into the vertical production bore. In an embodiment, a pressure transmitter is incorporated via a 2 1/16-inch (5.2 cm) diameter, 15 Ksi (103 MPa) pressure-rated API blind flange. The tree may have a casing elevator neck sized to the upper flange profile. In an embodiment, the tree may have a 13 3/8-inch (34 cm) diameter casing elevator neck and a 7 1/16-inch (17.9 cm) diameter, 15 Ksi (103 MPa) pressure-rated upper flange profile. Other parts and components of other sizes, diameters, dimensions and of other pressure-ratings that are known to one skilled in the art, or are commercially available, or are compatible with other commercially available components can also be used. The lower profile may have a transition joint that terminates with an easy makeup hub connector;

Riser crossover joint which interfaces with the internal tie-back string to the surface tree's transition point;

IWOCS HPU (existing). This component may have to be modified to interface with a SFT via a deck jumper and the rig's emergency shutdown and/or process safety systems;

IWOCS umbilical reel (existing); and an ESD (emergency shutdown) and EQD (emergency quick disconnect) stations that shall enable automatic surface and/or subsea shut-in and/or emergency disconnect of the riser.

When deployed subsea with IWOCS umbilical and drilling riser, the drilling operator will land out the LRP/EDP per standard operating procedure and the ROV will lock the tree connector before riser tensions are set. Tree interface tests will take place before the ROV makes-up both hydraulic and electrical flying leads to the tree.

The high pressure internal tie-back string tool is then deployed and landed out with the EDP. Before being landed out, the internal string is connected to the Surface Flow Tree's (SFT's) transition joint (already picked up) through the use of the riser crossover joint with easy make-up hub connector assembly. Also, the SFT will have rig flexible hoses made-up and tested before land out. The ROV will then lock the tie-back tool to the EDP body. This is followed by verifying interface through pressurizing the production bore via the rig's pumps. Both surface and subsea valves are then aligned and the riser's contents (sea water) will then be displaced to completion fluid. Depending on tree type, this displacement may also include circulating through the tree. Both the EDP barrier (i.e., the seal between the tie back and the EDP) and the LRP well barrier can then be pressure tested for integrity. At this juncture, the system is ready for well bore intervention via slickline, e-line, coiled tubing or jointed tubulars (provided the surface arrangement includes a hydraulic workover unit). Alternatively, the system may be used to clean-up, flow test or stimulate a well, diagnostic well work, or could be used for bullheading operations, to kill or shut-in a well, and for plugging wells and/or abandoning wells.

In the event systems of this disclosure are required to be safely shut-in, this can be initiated from any ESD station, and, depending on the situation, may involve a subsea shut-in and/or emergency disconnect. When a subsea shut-in and emergency disconnect is required, a sequence closure of the shear rams, isolation (gate) valves and connector disconnect will take place. Local hydraulic accumulators are used to assist shear ram closure and connector disconnect. The disconnect time may be less than 45 seconds and the EDP will be automatically picked up vertically since the riser tension will have been previously set to provide sufficient overpull and clearance at the LRP/EDP disconnect point while remaining within the riser's anti-recoil limits. When disconnected, the riser contents may be displaced before the EDP is relanded and connected by the ROV. In certain riserless intervention embodiments, wherein the well intervention operation comprises using a well bore intervention device selected from the group consisting of a slickline and an e-line such as embodiment 500 of FIG. 5A, in the event the well needs to be safely shut in, a sequence of closure steps is carried out using, in order, cutting the well bore intervention device using the EDP (such as a shear ram), and sealing the LRP (such as by use of a valve or ram). There is no need to disconnect the EDP in riserless interventions.

The systems and methods disclosed herein can be used in one or more operations related to well completion, flow testing, diagnostic well work, well stimulation, well workover, bullheading operations, plugging wells and/or abandoning wells where subsea trees or wellheads are installed. Further advantageous features of the inventive systems and methods are:

a greater operating envelope, which is not limited to 1 degree flex joint angles;

the incorporation of blind shears capable of cutting and sealing deep high-pressure high-temperature (HPHT) well intervention components;

the configuration of the well intervention systems and methods are simplified using proven and existing components;

the wellhead bending moment is reduced;

fewer offshore personnel may be required to run and operate the system;

there is an ability to circulate the contents of the internal riser before and after disconnect;

there is an ability to test and circulate between in-situ horizontal tree crown plugs;

the method and system uses the existing IWOCS (umbilical and HPU) of horizontal trees—no additional complex control system is required;

the method and system can use all marine drilling riser fluid conduits (choke, kill, boost and hydraulic supply) including the BOP HPU; and the system can readily be deployed from alternative drilling rigs without the need for new equipment with long lead times, or the need to commit to long term rentals.

From the foregoing detailed description of specific embodiments, it should be apparent that patentable methods and systems have been described. Although specific embodiments of the disclosure have been described herein in some detail, this has been done solely for the purposes of describing various features and aspects of the methods and systems, is not intended to be limiting with respect to the scope of the methods and systems. Further, the examples of the sizes, dimensions, diameters and pressure-ratings of the components and parts that may be useful in practicing the methods and systems disclosed herein, are not intended to be limiting with respect to the scope of the methods and systems. It is contemplated that various substitutions, alterations, and/or modifications, including but not limited to those implementation variations which may have been suggested herein, may be made to the described embodiments without departing from the scope of the appended claims.

What is claimed is:

1. A marine riser well intervention tie-back system comprising:

a) a lower riser package (LRP) comprising a tree connector, a connector and seal stab adapter (CSSA), and a lower riser package body (LRP body), wherein the tree connector comprises an upper flange having a gasket profile for mating to a lower end of the CSSA, wherein the CSSA comprises at least one seal stab assembly on its lower end for fluidly connecting to a subsea tree, wherein the LRP body is comprised of one or more LRP sealing elements capable of sealing upon command, and an integral annulus with at least one annulus isolation valve, and wherein the LRP body is further comprised of an upper hub profile compatible with a quick disconnect connector and lower flange profile that fluidly mates with the CSSA;

b) an emergency disconnect package (EDP) removably connected to the LRP, wherein: the EDP comprises a body (EDP body) having a quick disconnect connector on its lower end, one or more EDP sealing elements capable of sealing upon command, and at least one annulus isolation valve, the EDP body having an internal tie-back profile;

c) an internal tie-back tool (ITBT) removably connected to the EDP body via the internal tie-back profile; and d) a collapse-resistant flexible hose fluidly connecting the LRP to the subsea tree.

2. The system of claim 1, further comprising a marine riser, a riser mandrel connecting the marine riser to a flexible joint, the flexible joint connected to the body of the EDP, and pressure containing tubulars inserted through the marine riser and connected to the ITBT.

3. The system of claim 2, further comprising a first flexible hose connecting the marine riser via a marine riser mandrel to an annulus isolation valve of the EDP.

4. The system of claim 1, further comprising a choke or kill line.

5. The system of claim 4, further comprised of a second collapse-resistant flexible hose, wherein the flexible hose connects the LRP body to the subsea tree to provide another circulation path via the choke or kill line.

6. The system of claim 1, wherein the one or more EDP sealing elements comprises one or more sealing rams in the EDP body.

7. The system of claim 6, wherein at least one of said one or more rams is an inverted blind shear ram.

8. The system of claim 1, further comprising one or more subsystems from an existing BOP system, selected from a subsea tree's existing Installation WorkOver Control System (IWOCS) umbilical and HPU in conjunction with a subsea control system comprising an umbilical termination assembly (UTA), an ROV panel, accumulators, solenoid valves, an acoustic backup subsystem, a subsea emergency disconnect assembly (SEDA), hydraulic electric flying leads, or combinations thereof.

9. The system of claim 1, wherein the one or more LRP sealing elements are selected from the group consisting of at least one shearing ram and at least one sealing ram, at least one shearing-sealing ram, a gate valve, a ball valve, another type of valve, two or more shearing and sealing rams, two or more shearing-sealing rams, or a combination thereof.

10. A riserless well intervention system comprising:

a) a lower riser package (LRP) comprising a tree connector, a connector and seal stab adapter (CSSA), and a lower riser package body (LRP body), wherein the tree connector comprises an upper flange having a gasket profile for mating to a lower end of the CSSA, wherein the CSSA comprises at least one seal stab assembly on its lower end for fluidly connecting to a subsea tree, wherein the LRP body comprises one or more LRP sealing elements capable of sealing upon command, and an integral annulus with at least one annulus isolation valve, and wherein the LRP body comprises an upper hub profile compatible with a quick disconnect connector and lower flange profile that fluidly mates with the CSSA;

b) an emergency disconnect package (EDP) removably connected to the LRP, wherein the EDP comprises a body (EDP body) having a quick disconnect connector on its lower end, one or more EDP sealing elements capable of sealing upon command, and at least one annulus isolation valve;

c) an adapter removably connected to the EDP comprising a lower flange connection and an upper profile for connecting to a subsea lubricator;

d) a collapse-resistant flexible hose fluidly connecting the LRP to the subsea tree; and e) the subsea lubricator fluidly connected to the EDP by an adapter.

11. The system of claim 10, further comprised of a Multi-Support Rig (MSR), and one or more well intervention assemblies fed through the lubricator from the MSR, wherein the well intervention assembly is selected from the group consisting of a slick line, an e-line, or a combination thereof.

12. A marine riser well intervention tie-back system comprising:

a) a lower riser package (LRP) comprised of a tree connector, a connector and seal stab adapter (CSSA), and a lower riser package body (LRP body), wherein the tree connector comprises an upper flange having a gasket profile for mating to a lower end of the CSSA, wherein the CSSA comprises at least one seal stab assembly on its lower end for fluidly connecting to a subsea tree, wherein the LRP body comprises one or more LRP sealing elements capable of sealing upon command, and an integral annulus with at least one annulus isolation valve, and wherein the LRP body comprises an upper hub profile compatible with a quick disconnect connector and lower flange profile that fluidly mates with the CSSA;

b) an emergency disconnect package (EDP) removably connected to the LRP, wherein the EDP comprises a body (EDP body) having a quick disconnect connector on its lower end, one or more EDP sealing elements capable of sealing upon command, and at least one annulus isolation valve;

c) an open water completion workover riser system (CWOR), comprised of a riser, a surface tension system, and a surface tree, wherein the riser removably connects the surface tree to the body of the EDP; and d) a collapse-resistant flexible hose fluidly connecting the LRP to the subsea tree.

13. The system of claim 12, wherein the CWOR comprises at least one tapered stress joint, and wherein the surface tension system is selected from fixed lock-off tensioner systems, and hydro-pneumatic tensioner systems.

14. A method of well intervention, comprising:

a) deploying an emergency disconnect package (EDP)/lower riser package (LRP) stack subsea on a subsea tree connected to a well, the EDP/LRP stack being on an end of a marine riser;

i) wherein the LRP comprises a tree connector, a connector and seal stab adapter (CSSA), and a lower riser package body (LRP body), wherein the tree connector comprises an upper flange having a gasket profile for mating to a lower end of the CSSA, wherein the CSSA comprises at least one seal stab assembly on its lower end for fluidly connecting to a subsea tree, wherein the LRP body is comprised of one or more LRP sealing elements capable of sealing upon command, and an integral annulus with at least one annulus isolation valve, wherein the LRP body comprises an upper hub profile compatible with a quick disconnect connector and lower flange profile that fluidly mates with the CSSA;

ii) wherein the EDP removably connects to the LRP, wherein the EDP comprises a body (EDP body) having a quick disconnect connector on its lower end, one or more EDP sealing elements capable of sealing upon command, and at least one annulus isolation valve, and wherein the EDP body has an internal tie-back profile;

b) deploying an pressure containing tubulars with an internal tie-back tool (ITBT) attached thereto through the marine riser;

c) connecting the pressure containing tubulars to a surface flow tree;

d) landing the ITBT in the body of the EDP and locking the ITBT to the EDP body; and e) performing a well intervention operation using the EDP/LRP, ITBT, and pressure containing tubulars.

15. The method of claim 14, wherein well intervention operation is further comprised of deploying additional well intervention devices selected from the group consisting of slickline, e-line, coiled tubing, jointed tubulars, or a combination thereof.

16. The method of claim 14, wherein the well intervention operation is selected from the group consisting of well completion, well clean-up, flow testing, diagnostic well work, well stimulation, well workover, bullheading operations, for killing a well, for shutting-in a well, for plugging a well, for abandoning a well, or a combination thereof.

17. The method of claim 16, wherein, in the event the well needs to be safely shut in, a sequence of closure steps is carried out using, in order, the means for sealing in the LRP, the means for sealing in the EDP, and the quick disconnect connector of the EDP.

18. A method of riserless well intervention comprising:

a) deploying an emergency disconnect package (EDP)/lower riser package (LRP) stack subsea on a subsea tree connected to a well;

i) wherein the LRP comprises a tree connector, a connector and seal stab adapter (CSSA), and a lower riser package body (LRP body), wherein the tree connector comprises an upper flange having a gasket profile for mating to a lower end of the CSSA, wherein the CSSA comprises at least one seal stab assembly on its lower end for fluidly connecting to a subsea tree, wherein the LRP body comprises one or more LRP sealing elements capable of sealing upon command, and an integral annulus with at least one annulus isolation valve, and wherein the LRP body comprises an upper hub profile compatible with a quick disconnect connector and lower flange profile that fluidly mates with the CSSA;

ii) wherein the EDP removably connects to the LRP, wherein the EDP comprises a body (EDP body) having a quick disconnect connector on its lower end, one or more EDP sealing elements capable of sealing upon command, and at least one annulus isolation valve, and wherein the EDP body has an internal tie-back profile;

iii) wherein the EDP has an adapter removably attached to the EDP body, and a lubricator removably attached to the adapter; and b) performing a well intervention operation using the EDP/LRP and lubricator.

19. The method of claim 18, wherein well intervention operation further comprises using a well bore intervention device selected from the group consisting of a slickline, an e-line, or a combination thereof.

20. The method of claim 18, wherein the well intervention operation is selected from the group consisting of well clean-up, flow testing, diagnostic well work, well stimulation, well workover, bullheading operations, for killing a well, for shutting-in a well, for plugging a well, for abandoning a well, or a combination thereof.

21. The method of claim 20, wherein if the well must be shut in, a sequence of closure steps is carried out by first cutting the well bore intervention device, and then sealing the LRP by using said one or more LRP sealing elements.

22. A method of well intervention, comprising:

a) deploying an emergency disconnect package (EDP)/lower riser package (LRP) stack subsea on a subsea tree connected to a well, wherein the EDP/LRP stack is a sub-system of an open water completion workover riser system (CWOR), wherein the CWOR system comprises a tapered stress joint, one or more riser joints, a surface tension joint, surface termination joints, a surface tree and surface tension system, and wherein the CWOR system fluidly connects the surface tree to a body of the EDP (EDP body);

i) wherein the LRP is comprised of a tree connector, a connector and seal stab adapter (CSSA), and a LRP body, wherein the tree connector comprises an upper flange having a gasket profile for mating to a lower end of the CSSA, wherein the CSSA comprises at least one seal stab assembly on its lower end for fluidly connecting to the subsea tree, wherein the LRP body comprises one or more LRP sealing elements capable of sealing upon command, and an integral annulus with at least one annulus isolation valve, and wherein the LRP body comprising an upper hub profile compatible with a quick disconnect connector and lower flange profile that fluidly mates with the CSSA;

ii) wherein the EDP removably connects to the LRP, and wherein the EDP comprising a body (EDP body) having a quick disconnect connector on its lower end, one or more EDP sealing elements capable of sealing upon command, and at least one annulus isolation valve, the EDP body having an internal tie-back profile; and b) performing a well intervention operation using the EDP/LRP stack and CWOR system.

23. The method of claim 22, wherein the well intervention operation further comprises using a well bore intervention device selected from the group consisting of a slickline, an c-line, or a combination thereof.

24. The method of claim 22, wherein the well intervention operation is selected from the group consisting of well completion, well clean-up, flow testing, diagnostic well work, well stimulation, well workover, bullheading operations, for killing a well, for shutting-in a well, for plugging a well, for abandoning a well, or a combination thereof.

25. The method of claim 22, wherein one or more steps employ an ROV.

26. The method of claim 24, wherein if the well must be shut in, a sequence of closure steps is carried out by first sealing the LRP, sealing the EDP, and causing the quick disconnect connector of the EDP to disconnect.

* * * * *